United States Patent [19]

Sweeney

[11] 4,368,994

[45] Jan. 18, 1983

[54] SINGLE SERVO DRIVEN PRINTER

[75] Inventor: David F. Sweeney, Alamo, Calif.

[73] Assignee: The Singer Company, Stamford, Conn.

[21] Appl. No.: 63,871

[22] Filed: Jun. 20, 1979

Related U.S. Application Data

[63] Continuation of Ser. No. 695,884, Jul. 14, 1976, abandoned, which is a continuation of Ser. No. 619,729, Oct. 6, 1975, abandoned, which is a continuation of Ser. No. 465,972, May 1, 1974, abandoned.

[51] Int. Cl.[3] ..... B11J 19/00

[52] U.S. Cl. ..... 400/320; 400/322; 400/328; 400/568; 400/569; 400/584; 400/585; 400/616.1; 400/636.2

[58] Field of Search ..... 400/124, 185, 186, 187, 400/305, 317.1, 320, 322, 328, 583.2, 584, 585, 585.1, 616.1, 636.2, 338.2

[56] References Cited

U.S. PATENT DOCUMENTS

| | | | |
|---|---|---|---|
| 3,185,078 | 5/1965 | Pensavecchia | 400/616.1 |
| 3,324,240 | 6/1967 | Kleinschmidt et al. | 400/124 X |
| 3,429,414 | 2/1969 | Bradbury | 400/322 X |
| 3,444,977 | 5/1969 | Kinney et al. | 400/616.1 X |
| 3,452,853 | 7/1969 | Mabon | 400/583.2 |
| 3,554,347 | 1/1971 | Perkins | 400/320 |
| 3,628,645 | 12/1971 | McFeaters | 400/320 |
| 3,653,483 | 4/1972 | Cortona et al. | 400/585 X |
| 3,670,861 | 6/1972 | Zenner et al. | 400/338.2 |
| 3,819,028 | 6/1974 | Drillick | 400/328.1 X |

*Primary Examiner*—Ernest T. Wright, Jr.
*Attorney, Agent, or Firm*—Robert E. Smith; Edward L. Bell

[57] ABSTRACT

A printer which may be used in a billing/accounting machine having a single servo motor to drive both the printing mechanism (horizontal motion) and the record media feed (vertical motion). While the printing mechanism is always engaged with the servo motor for transportation across the record media, provision is made for disengaging the record media feed from the servo motor during the printing mode and for re-engaging the record media feed with the servo motor during the non-printing mode for the proper feeding of the media past the printing mechanism to provide line-by-line printing. With the printing mechanism continuously engaged, its exact horizontal position is always known and controlled.

3 Claims, 12 Drawing Figures

SINGLE SERVO DRIVEN PRINTER

This is a continuation of application Ser. No. 695,884, filed July 14, 1976, now abandoned, which is a continuation of application Ser. No. 619,729 filed Oct. 6, 1975, now abandoned, which is a continuation of application Ser. No. 465,972 filed May 1, 1974, now abandoned.

CROSS-REFERENCE TO RELATED APPLICATIONS

U.S. application of Shah et al, filed Nov. 14, 1973, Ser. No. 415,886, and entitled "Paper Transport and Control Mechanism for Printer", now abandoned.

BACKGROUND OF THE INVENTION

Various types of record media supply and control devices have been designed in the prior art for the purpose of feeding printers, for accounting machines, billing machines, and other graphic-type devices.

Usually such printers are provided with a means for transporting a printing mechanism, usually an impact type printer, across the face of a platen (roller) where the printing takes place, and a means for feeding, or transporting, the train of paper (record media) to and around the platen where printing, typing or other activities may take place on the paper train. In such prior art devices, a separate servo motor was utilized to transport the printing mechanism across the platen for line printing and a separate servo motor was utilized to drive the transport mechanism for supplying the record media to the platen, with suitable timing controls provided so that the feeding of the record media did not interfere with the printing mechanism during the printing mode and proper columns and lines were thus formed.

The problem with such prior art devices is that the dual servo motor system, as separate drives of the printing mechanism transport and the media feed, significantly increased the cost and size and space requirements of such devices. As to single drive systems, while not practical in the past, the high speeds achievable with servo motor drives allow mechanical motions to be overlapped without significant impact on the thruput of the device.

SUMMARY OF THE INVENTION

This invention teaches the manner in which a single servo drive motor is used to drive both the printing mechanism and the record media feeding mechanism in a printer to accomplish a significant cost reduction and space requirement reduction with a minimum of performance impact over prior art devices. This invention utilizes suitable clutch mechanisms so that a single servo motor will not only drive the printing mechanism, but also will drive the record media feed mechanism at the appropriate time when the printing mechanism is not in the printing mode. Most importantly, the printing mechanism (horizontal motion) is always engaged so that its location relative to the media is always known and controlled while feed mechanism (vertical motion) is engaged and disengaged from the servo motor. Specifically, when the printer is in the mode to print in one direction only, i.e., from left to right across the record media and the printing mechanism has traversed the media and completed printing the required characters in a line, it is during the time that the printing mechanism is being returned to the left margin of the media that the servo motor is engaged by the feed mechanism to transport the record media relative to the platen where the next print line is to begin. This may be only a single or double space for the next print line or may be several spaces on an accounting/billing form, or even to the next succeeding form on a train of forms comprising the record media. When the printer is in the mode to print in both directions across the print platen and when the printing mechanism has traversed the media for printing a line of characters within a margin on the record media, the printing mechanism is transported beyond the margin, at which time the single servo motor is engaged to the feed mechanism to transport the record media to respond to the next line to be printed, while at the same time positioning the printing mechanism at the margin to begin the next print line.

DESCRIPTION OF THE PREFERRED EMBODIMENTS

Figure 1:
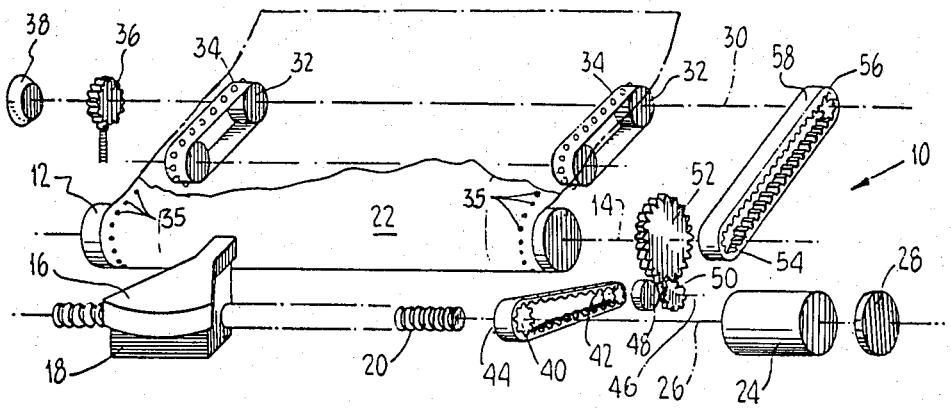
FIG. 1 is a perspective and schematic illustration of the printer eliminating all unnecessary components to more aptly show the invention.

Referring now to FIG. 1, the printer, indicated in its entirety as 10, is shown as comprising a platen 12, a platen shaft 14, with a printing mechanism or print head 16, shown in this embodiment as a matrix printer, mounted by a carriage 18 on a rotatable lead screw 20 for transporting the print head 16 back and forth across the platen 12 for printing on record media 22 positioned in front of the platen 12. The lead screw 20 is driven both clockwise and counterclockwise by a servo motor 24 directly connected to its drive shaft 26 and, to correlate the position of the print head 16 for printing purposes, a shaft-to-position encoder 28 is mounted on the shaft 26. In this invention, the encoder 28 will always accurately reflect the exact position of the print head 16 relative to the platen 12/media 22, since at no time is the servo motor 24 disengaged from the lead screw 20.

To transport the record media 22 in this embodiment, the servo motor 24 is connected also to the platen shaft 14 and to the splined tractor shaft 30. The platen 12 is, of course, held stationary during the printing mode, with the record media 22 being held in position in front of the platen 12 by both the platen 12 itself and a pair of tractor units 32 mounted on a splined tractor shaft 30, each having drive pins 34 to engage perforations 35 in the record media 22 for a positive grip and for control of the paper motion and tension. Since these tractor units 32 are more fully described in the Shah et al application, Ser. No. 415,886, supra, no further description will be set forth herein.

Splined tractor shaft 30 is also provided with a ratchet detent 36 normally operable by knob 38. Ratchet detent 36 serves to hold the media 22 during printing and the knob 38 aids the operator in manually spacing lines of print in the conventional manner.

To drive platen shaft 14 and splined tractor shaft 30 by motor 24, drive shaft 26 drives a toothed pulley 40 which, in turn, drives a driven second toothed pulley 42 through a toothed belt 44. Toothed belt 44 is flexible to allow servo motor 24 and lead screw 20 to be adjusted for best lead screw nut fit. The shaft 46 of the driven toothed pulley 42 is connected through an electromagnetic clutch 48 which, when in engaged condition, drives a third pinion gear 50 and an intermeshing relatively large gear 52 on the platen shaft 14. This same gear 52 also drives a third toothed pulley 54 which drives a fourth toothed pulley 56 through a cog belt 58. Obviously, when electromagnetic clutch 48 is disengaged, toothed pulley 42 simply rotates freely to permit the servo motor 24 to rotate the lead screw 20 independently of the platen shaft 14 and the tractor shaft 30.

Figure 2A:
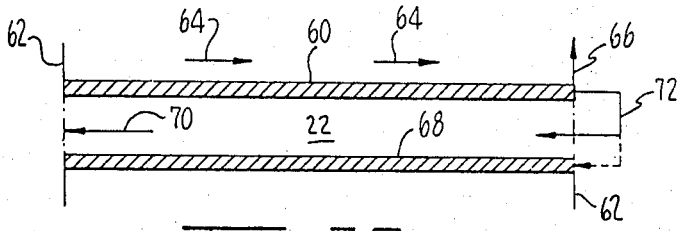
FIG. 2A is a schematic illustration showing of the unidirectional line-by-line printing of the profile of FIG. 2A, with the arrows indicating the path of travel of the printing mechanism and the path of travel of the record media and the approximate time when the media is transported relative to the position of the printing mechanism.
Figure 2B:
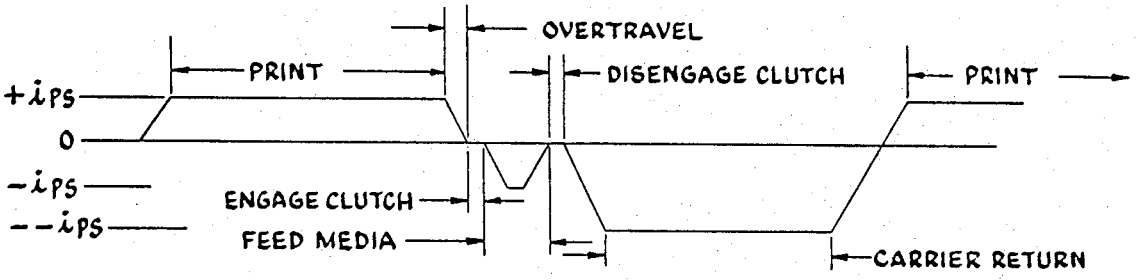
FIG. 2B is a velocity profile for line-by-line printing in one direction only.

Having described the means to transport the print head 16 for printing purposes, e.g., horizontal drive, and the means to transport the record media 22, e.g., vertical drive with the horizontal drive being independent of the vertical drive, yet all by the same power source, attention is now directed to FIGS. 2A and 2B which serve to illustrate the manner in which the servo motor 24 is controlled for unidirectional printing. In FIG. 2A the record media 22 is shown with a line 60 of printed characters between the margins 62 printed in a direction from left to right, as indicated by the arrow 64. Arrow 66 indicates the vertical motion of the media 22 for the next line of printing 68 while arrow 70 indicates the direction of return of the print head 16 to the left margin 62 during the non-printing mode, with the short arrow 72 indicating the overtravel beyond the right margin 62; during which overtravel and/or non-printing mode the electromagnetic clutch 48 was engaged so that the platen shaft 14 and the tractor shaft 30 were rotated to move the record media 22 in the direction indicated by arrow 66. (Actually, the return portion of arrow 72 and arrow 70 would coincide with print line 68 as shown in dotted lines but are shown displaced in this drawing for clarity.) This movement is more clearly indicated in the velocity profile in inches/seconds (ips) of FIG. 2B, which shows the velocity of the lead screw 20 rotation when in the printing mode, at the time when the clutch 48 is engaged for transporting the record media 22, and at the time in which the print head 16 is returned by further rotation of the lead screw 20. Note, to save clutch 48 wear, the clutch 48 engages or disengages during the time of zero velocity of the lead screw 20 and shaft 26, and toothed pulley 42 and pinion 50.

Figure 3A:
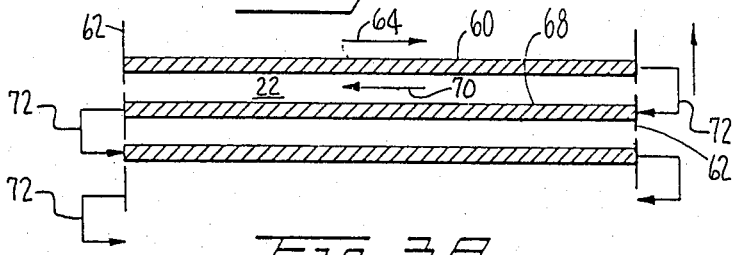
FIG. 3A is a drawing similar to FIG. 2A but showing bidirectional printing.
Figure 3B:
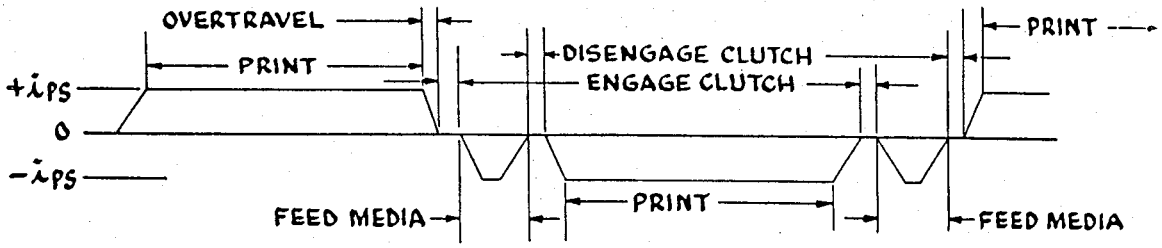
FIG. 3B is a velocity profile for bidirectional printing.

Turning now to FIGS. 3A and 3B, it can be seen that FIG. 3A illustrates the printing on the record media 22 in a bidirectional manner, noting that the arrow 72 shows that the print head 16 is transported beyond the right margin 62 of the print before returning to the next following print line 68, at which time the record media 22 may be transported by the engagement of the clutch 48 in sufficient length of time to transport the record media 22 the required distance. FIG. 3B shows the velocity profile in inches/seconds (IPS) of the print head 16 showing the times when the clutch 48 is engaged and disengaged, the overtravel for the media 22 feed beyond the margins 62 as shown in FIG. 3A, and the return of the print head 16 while printing in the bidirectional mode. Note here, too, the clutch 48 is engaged or disengaged when the velocity of the servo motor shaft 26 and its driven elements 40, 42, 44 is zero.

Again, in both printing modes, unidirectional and bidirectional, the servo motor 24 is continuously connected to the lead screw 20 so that the encoder 28 can continuously and accurately monitor the position of the print head 16 relative to the record media 22.

By way of example in the foregoing, if the record media 22 is a standard business form, it contains the space for 132 characters between the margins 62. The time required to move the media 22 one space for single space printing equals and time and distance required to print two characters, which is indicated by the short arrow 72. It is apparent also that so long as the print head 16 has plenty of time to travel to the left-hand margin 62, there is also a sufficient time to space the media 22 for printing on any of several spaces or even to the next form in a train of forms (which, by convention in the standard business form is 11 inches) as the print head 16 is moved horizontally to the left margin 62.

Figure 4:
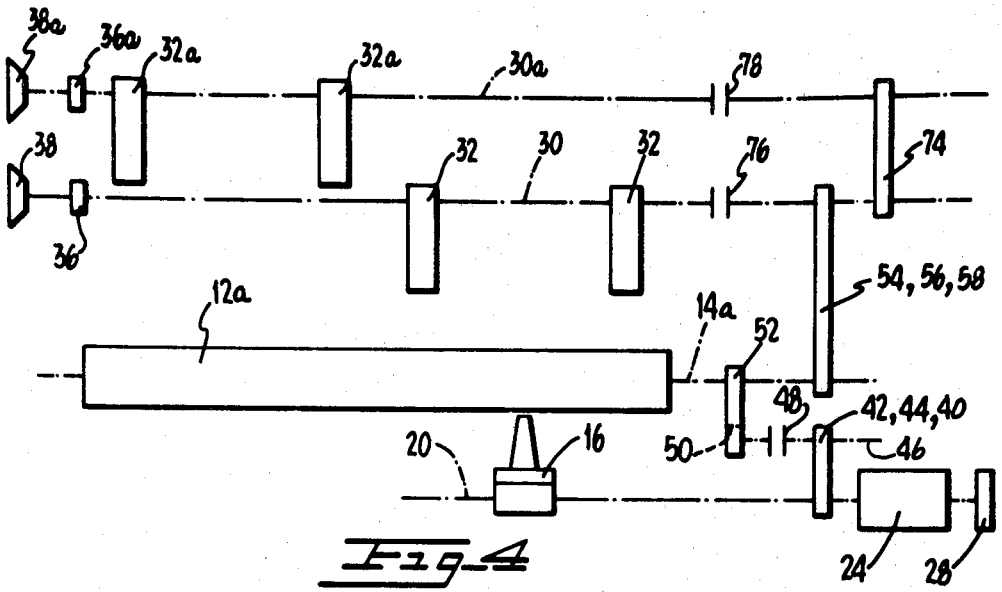
FIG. 4 is a schematic illustration of the printer incorporating the present invention for printing wide copy or plural copies on the same platen and utilizing dual tractor sets.

FIG. 4 shows a double length platen **12*a* with an extra set of tractors 32*a* mounted on an additional tractor splined shaft 30*a* with its own ratchet detent 36*a* and knob 38*a* for manual operation. Tractor spline shaft 30*a* is driven by a second pinion/cog belt combination 74 driven off the tractor spline shaft 30. This embodiment is additionally provided with a pair of electromagnetic clutches 76 and 78 (unnecessary in the embodiment shown in FIG. 1) to provide independent operation of the splined shafts 30, 30*a* in the event independent operation of either shaft 30 or 30*a* is desired. This embodiment operates in a manner similar to that described in connection with FIG. 1**, and the use of the suffix "a" on the reference numerals indicates like function and operation of the similar parts.

Figure 5:
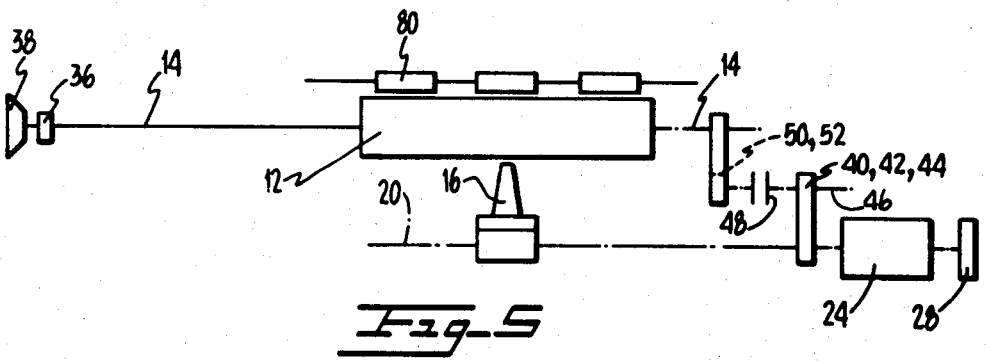
FIG. 5 is a schematic illustration of the printer incorporating the present invention for typewriter type operation.

While the foregoing description of the invention was directed to a means of transporting the record media 22 which comprised a driven platen shaft 14 and a splined tractor shaft 30, for tractor fed forms, FIG. 5 shows a typewriter-type printer for cut forms, without tractors, but with manually actuated pressure rollers 80 driven off the platen 12, which also has a ratchet 36 and a knob 38 for manual control and operation on the platen shaft 14. The operation of this embodiment is the same as FIGS. 1 and 2 as indicated by like parts having the same reference numerals, but forms and other media are inserted in this printer and are handled in the same manner as a conventional typewriter.

Figure 6:
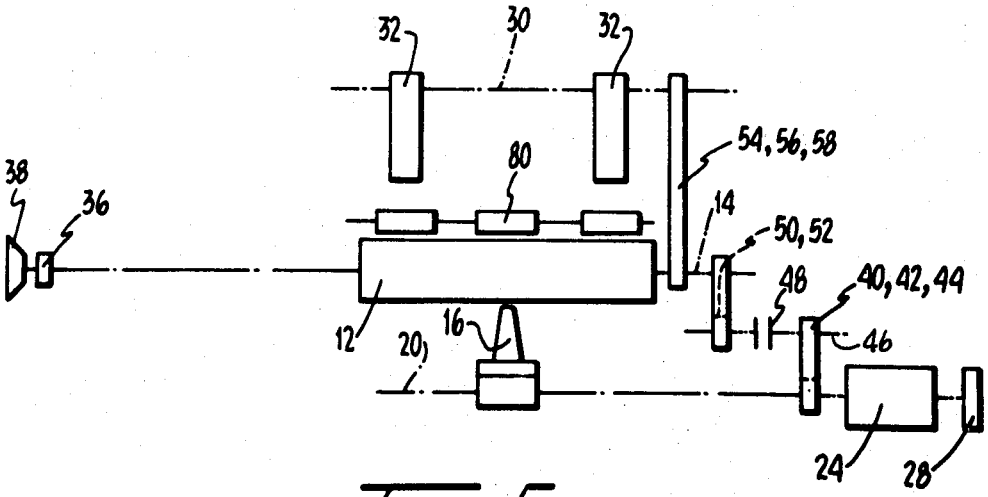
FIG. 6 is a schematic illustration like FIG. 5 but capable of printing on tractor fed forms and cut forms.

FIG. 6 shows the pressure rollers 80 utilized in connection with a platen 12, such as shown in FIG. 5, but also with tractors 32 for tractor fed forms capability.

Again, this embodiment performs in exactly the same manner as that described in connection with FIGS. 1 and 5.

Figure 7:
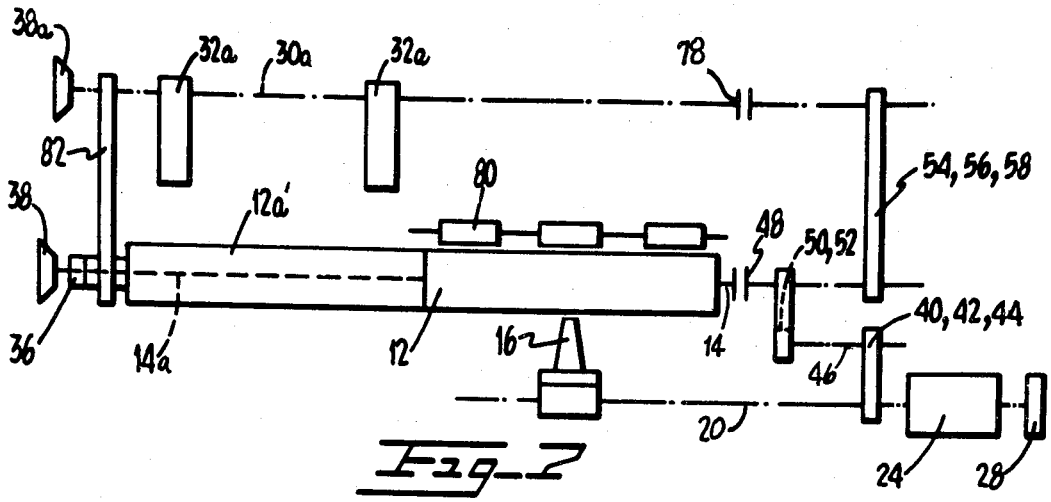
FIG. 7 is a schematic illustration of the present invention with a split platen for independent printing on cut and tractor fed forms.

FIG. 7 is still another version of the invention in which a double length split platen 12 and 12*a*′ is utilized to provide more versatility for the printer. In this version, the platen 12, with its pressure rollers 80, operating like a conventional typewriter as described in connection with FIG. 5 above, will permit an operator to type on a cut form and later transfer the information on the form to the tractor fed form at platen 12*a*. The information typed on the cut form at platen 12 is transposed to a memory device, such as a magnetic memory or belt, and at the appropriate time the information in the memory is read out so as to print automatically at the tractor fed platen 12*a*′. In this embodiment, platen 12*a*′ is driven off the spline shaft 30 by a pinion/cog belt combination 82 driving sleeve shaft 14*a*′ concentric to shaft 14. This latter shaft 14*a*′ is also provided with a knob 38 and ratchet 36 for manual operation of the platen 12. Again, like the preceding embodiments, like reference numerals denote similar parts in the preceding embodiments.

Figure 8:
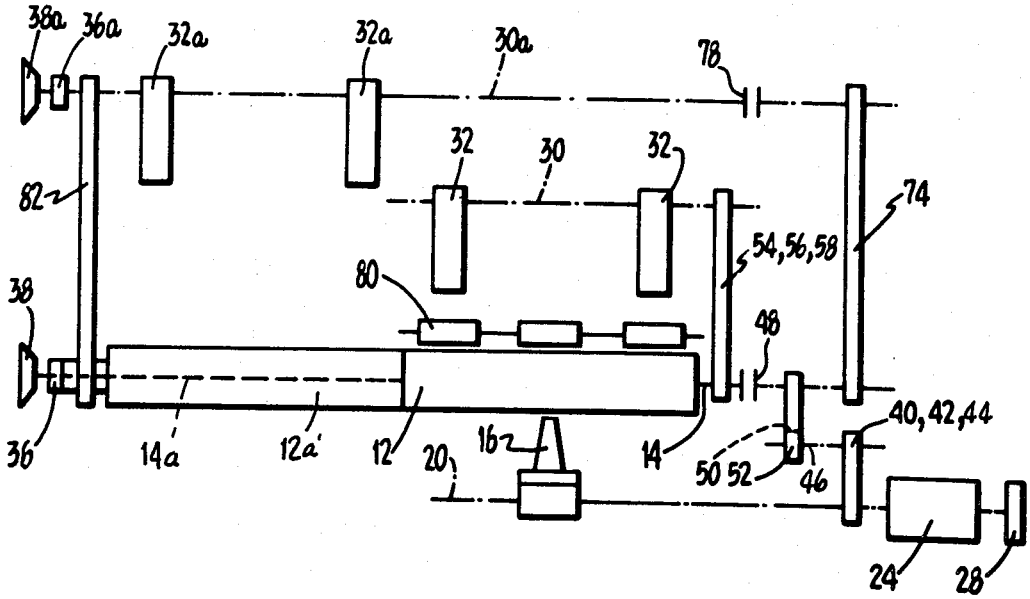
FIG. 8 shows the invention of FIG. 7 with dual tractors for additional capabilities.

FIG. 8 is another version which combines the pressure roller 80 with the tractors 32*a* which work in conjunction with the platen 12 to provide the additional versatility to permit cut forms and tractor fed forms to be utilized. Otherwise, this version operates identical to that described in connection with FIG. 7.

Figure 9:
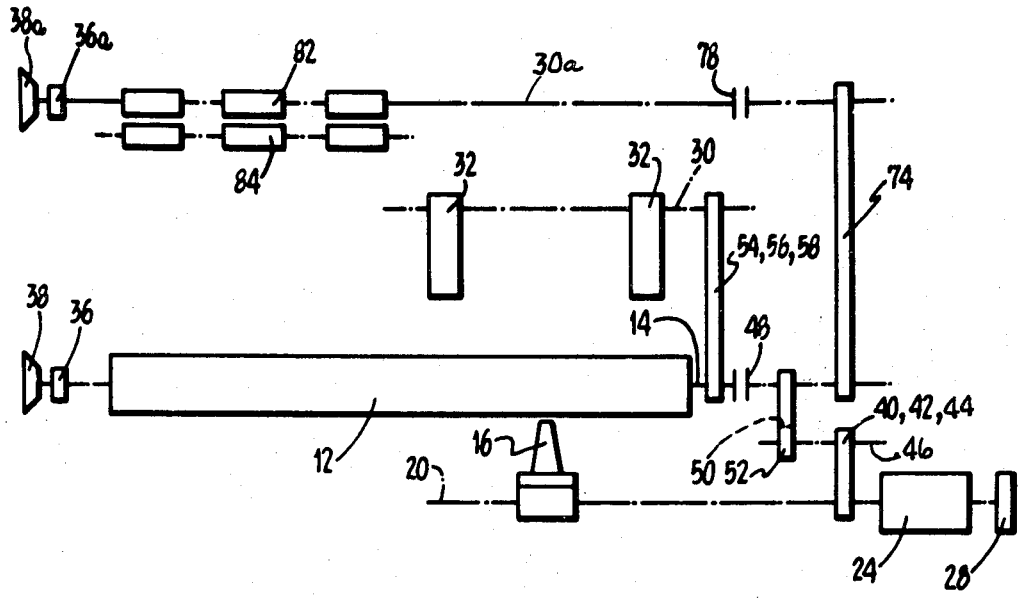
FIG. 9 shows the invention with an elongated platen like FIG. 4 but with front feed pressure rollers in lieu of tractors on one side for cut forms.

FIG. 9 shows a single elongated platen 12 with tractors 32 and, in lieu of tractors on the splined shaft 30*a*, a set of driven rollers 82 function with the rollers 84 for a separate feed for the platen 12. Obviously, in this embodiment, cut forms may be accommodated through the pressure rollers 82 and 84. This embodiment otherwise functions in the manner similar to that described in connection with the preceding versions, but does not require platen drive.

Figure 10:
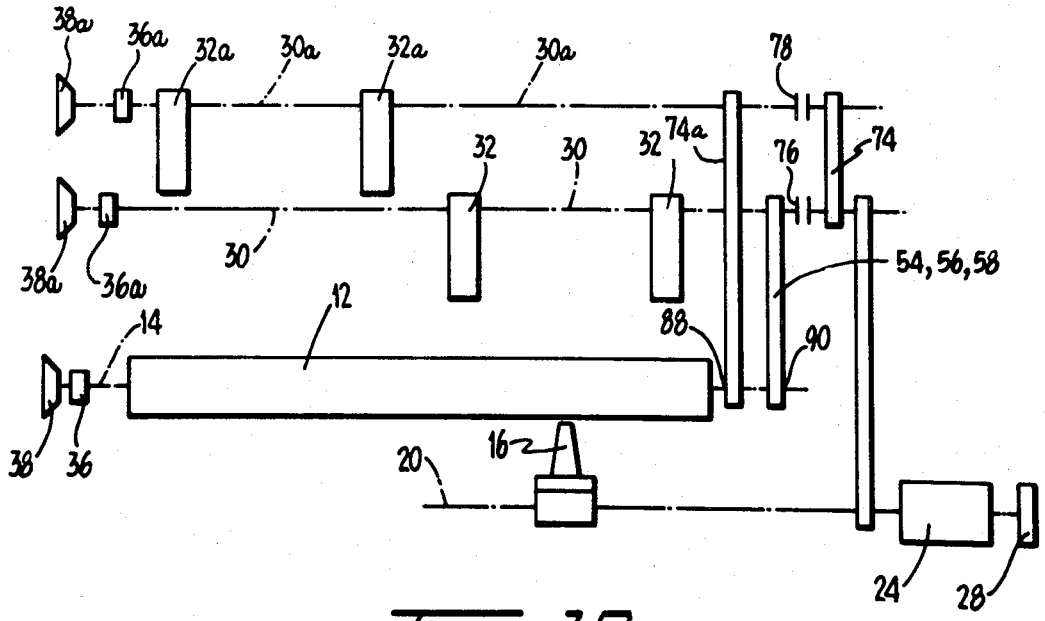
FIG. 10 shows a simplified version of FIG. 4 illustrating a clutch between the servo motor and platen shaft.

FIG. 10 is still another version of the invention showing the double tractor sets 32 and 32*a* but eliminating the clutch 48 so that the platen drive shaft 14 may be driven from the splined shafts 30 and 30*a* through additional sets of pinion/cog belt combinations, such as 54–58 and 74*a* of the version shown in FIGS. 1–9. However, a pair of sprag-type one-way clutches 88, 90 are functionally located between the cog belt drive combinations 54, 56, 58 and 74*a* respectively so that the platen is driven as the spline shafts 30, 30*a* are driven but in one direction only. This permits freedom of movement of the platen 12 for the insertion of the forms, eliminates interaction between the two drives, etc.

From the foregoing it can be seen that there is disclosed a single servo drive system for a printer which is quite versatile and accomplishes a significant cost reduction and space requirement reduction with a minimum of performance impact over prior art devices, and which the description dealt with unidirectional feed of the record media, bidirectional feeding is not precluded from the system described.

What is claimed is:

1. A printer having a platen and a print head for printing characters on record media comprising:

means establishing on said platen preselected margins for said record media;

a carriage having said print head secured thereto;

a lead screw arranged in uninterrupted driving engagement with said carriage and rotatable so as to transport said carriage and said print head transversely back and forth across said preselected margins for said record media on said platen;

a servo motor permanently mechanically secured in uninterrupted driving engagement with said lead screw so as to continuously drive the lead screw upon actuation thereof to provide the sole means for controlling the position of said print head transversely across said record media;

said transport of said print head by said servo motor occurring in selected printing mode segments within said preselected margins for said record media, and other selected non-printing mode segments of transport of said print head occurring when said print head occupies positions beyond said predetermined margins;

said print head being actuated only during said selected printing mode segments of transport of said print head within said preselected margins for said record media;

record media transport means for transporting said record media relative to the platen for line-by-line and column printing; and means for connecting and disconnecting said record media transport means with said servo motor;

said means for connecting and disconnecting said record media transport means with said servo motor being engageable and disengageable with said servo motor only during said other selected non-printing mode segments of transport of said print head.

2. A printer as set forth in claim 1 characterized in:

said print head being actuated to provide for said printing mode segments only during movement of said print head by said servo motor in one direction transversely across said record media;

actuation of said print head being suspended to provide for non-printing mode segments during movement of said print head in the opposite direction transversely across said record media; and said means for connecting and disconnecting said record media transport means with said servo motor being engageable and disengageable with said servo motor only during said non-printing mode segments during movement of said print head in the opposite direction transversely across said record media.

3. A printer as set forth in claim 1 characterized in:

said transport of said print head by said servo motor occurring in selected printing mode segments within said preselected margins for said record media and in only one direction transversely across said preselected margins, and other selected non-printing mode segments of transport of said print head occurring when said print head occupies positions beyond said predetermined margins and during movement of said print head in the opposite direction across said preselected margins;

said print head being actuated only during said selected printing mode segments of transport of said print head within said preselected margins for said record media; and said means for connecting and disconnecting said record media transport means with said servo motor being engageable and disengageable with said servo motor only during said other selected non-printing mode segments of transport of said print head.

* * * * *